US008210187B1

(12) United States Patent
Zhang

(10) Patent No.: US 8,210,187 B1
(45) Date of Patent: Jul. 3, 2012

(54) COSMETIC POWDER DISPENSER

(75) Inventor: Derik Zhang, Dongguan (CN)

(73) Assignee: Lava Industries, Inc., El Monte, CA (US)

( * ) Notice: Subject to any disclaimer, the term of this patent is extended or adjusted under 35 U.S.C. 154(b) by 119 days.

(21) Appl. No.: 12/661,820

(22) Filed: Mar. 25, 2010

(51) Int. Cl.

| | |
|---|---|
| ***A45D 33/02*** | (2006.01) |
| ***A47G 19/00*** | (2006.01) |
| ***A47G 19/24*** | (2006.01) |
| ***B67D 7/76*** | (2010.01) |
| ***B65D 47/00*** | (2006.01) |

(52) U.S. Cl. ..... 132/299; 132/298; 132/307; 222/142.9; 222/189.02; 222/565

(58) Field of Classification Search ..... 132/299, 132/293–295, 298, 300, 303–307, 314, 315; 206/581, 823; 220/501, 506, 528–531, 291, 220/811; 222/189.02, 189.03, 189.05, 311, 222/565, 390, 480, 142.9, 548, 142.6, 142.7, 222/144, 427, 436, 452, 365; 401/123, 124, 401/138, 139, 145, 191, 196, 202, 280, 281, 401/82; 209/235; 119/51.04

See application file for complete search history.

(56) References Cited

U.S. PATENT DOCUMENTS

| | | | | |
|---|---|---|---|---|
| 875,948 | A | 1/1908 | Racouillatt et al. | |
| 1,121,786 | A | 12/1914 | Bongiovanni | |
| 1,193,223 | A * | 8/1916 | Beckmann | 132/299 |
| 1,481,499 | A | 1/1924 | Bongiovanni | |
| 1,506,292 | A | 8/1924 | Corsello | |
| 1,642,780 | A * | 9/1927 | Kole et al. | 132/295 |
| 1,695,677 | A | 12/1928 | Barany | |
| 1,794,344 | A * | 2/1931 | Soyez | 132/299 |
| 1,832,313 | A * | 11/1931 | Maillard | 132/299 |
| 1,847,949 | A * | 3/1932 | Kasdan et al. | 132/299 |
| 1,855,170 | A | 4/1932 | Kasdan et al. | |
| 1,855,399 | A | 4/1932 | Klotz | |
| 1,866,116 | A | 7/1932 | Leidel | |
| 1,895,187 | A * | 1/1933 | Friedman | 132/299 |
| 1,900,089 | A | 3/1933 | Batchelor | |
| 1,911,691 | A * | 5/1933 | Jacobson | 132/299 |
| 2,554,489 | A * | 5/1951 | Crane | 401/125 |
| 2,562,647 | A * | 7/1951 | Shaver | 222/480 |
| 2,568,814 | A * | 9/1951 | Marcellus | 222/520 |
| 3,760,985 | A * | 9/1973 | Bryan | 222/136 |
| 4,647,240 | A | 3/1987 | Ladd, Jr. et al. | |
| 4,944,625 | A | 7/1990 | Futter et al. | |
| 4,961,521 | A | 10/1990 | Eckman | |
| 4,974,981 | A * | 12/1990 | Bennett | 401/123 |
| 5,402,921 | A * | 4/1995 | Forsyth et al. | 222/541.6 |
| 5,626,260 | A * | 5/1997 | Waldner | 222/144 |
| 6,053,183 | A * | 4/2000 | Rizzo | 132/307 |
| 6,148,995 | A * | 11/2000 | De Laforcade | 206/219 |
| 6,283,339 | B1 * | 9/2001 | Morrow | 222/452 |
| 6,457,891 | B1 * | 10/2002 | Bredacts | 401/123 |
| 6,474,346 | B1 * | 11/2002 | Jang | 132/307 |
| 6,945,403 | B2 * | 9/2005 | Lombardi | 206/581 |

(Continued)

*Primary Examiner* — Todd E. Manahan
*Assistant Examiner* — Vanitha Elgart
(74) *Attorney, Agent, or Firm* — William W. Haefliger

(57) ABSTRACT

A cosmetic powder dispenser, comprising a housing structure forming upper, intermediate and lower compartments, the structure forming through openings in registering walls associated with the compartments, the housing structure including upper and intermediate rotors whereby rotation of the upper rotor enables a metered quantity of powder to gravitate through a first of the openings from the upper to the intermediate compartment, and whereby rotation of the intermediate rotor enables metered quantity of powder to gravitate through an additional opening from the intermediate compartment to the lower compartment, for use.

8 Claims, 2 Drawing Sheets

U.S. PATENT DOCUMENTS

| | | | | |
|---|---|---|---|---|
| 7,273,059 | B2 * | 9/2007 | Lee | 132/299 |
| 7,494,030 | B2 * | 2/2009 | Bennett | 222/480 |
| 7,503,331 | B2 * | 3/2009 | Eng et al. | 132/294 |
| 7,841,349 | B2 * | 11/2010 | Bennett | 132/306 |
| 8,006,707 | B2 * | 8/2011 | Thorpe et al. | 132/307 |
| 2002/0141807 | A1 * | 10/2002 | Bredacts | 401/123 |
| 2003/0024545 | A1 * | 2/2003 | Delage | 132/299 |
| 2005/0102978 | A1 * | 5/2005 | Gueret | 53/471 |
| 2007/0228083 | A1 | 10/2007 | Catani | |
| 2007/0290009 | A1 * | 12/2007 | Fuchs | 222/480 |
| 2008/0178814 | A1 * | 7/2008 | Tseng | 119/51.04 |
| 2008/0178903 | A1 * | 7/2008 | Thorpe et al. | 132/307 |
| 2008/0264440 | A1 * | 10/2008 | Thorpe | 132/299 |
| 2008/0276956 | A1 * | 11/2008 | Cho | 132/294 |
| 2009/0001104 | A1 | 1/2009 | Ranney | |
| 2009/0272400 | A1 * | 11/2009 | Park et al. | 132/298 |
| 2009/0308409 | A1 * | 12/2009 | Zhu et al. | 132/299 |
| 2010/0000568 | A1 * | 1/2010 | Fraillon | 132/299 |
| 2010/0012145 | A1 * | 1/2010 | LoPrete | 132/307 |
| 2010/0236572 | A1 * | 9/2010 | Guenther et al. | 132/299 |
| 2010/0252586 | A1 * | 10/2010 | Jimenez et al. | 222/480 |
| 2010/0307530 | A1 * | 12/2010 | Bennett | 132/307 |

* cited by examiner

COSMETIC POWDER DISPENSER

BACKGROUND OF THE INVENTION

This invention relates generally to dispensing of cosmetic powder, and more particularly to controlled and metered dispensing of such powder.

There is need for means to control and thereby conserve cosmetic powder use and dispensing, and also to enable controlled powder metering dispensing by means of apparatus that is easily usable and storable in readily dispensing mode, for simple, reliable instant use.

SUMMARY OF THE INVENTION

It is a major object of the invention to provide an improved and preferred cosmetic powder dispenser meeting the above need. Basically, the dispenser comprises a) housing structure forming upper, intermediate and lower compartments, the structure forming through openings in registering walls associated with the compartments, b) The housing structure including, upper and intermediate rotors whereby rotation of the upper rotor enables a metered quantity of powder to gravitate through a first of the openings from the upper to the intermediate compartment, and whereby rotation of the intermediate rotor enables said metered quantity of powder to gravitate through an additional opening from the intermediate compartment to the lower compartment, for use.

Another object comprises provision of a screen in the lower compartment to receive contact with powder gravitated into the lower compartment. Typically the screen has a concave side facing the interior of the lower compartment, for exposure and mixing, as well as a convex side to receive excess powder from the screen concave side, for storage and later disposal. Also, the housing typically has a receptacle facing that screen convex side, for receiving the excess powder.

A yet further object comprises provision of a hinge connecting the receptacle to other wall structure of the housing. In this regard, the upper and intermediate compartments effectively define a lid covering the interior of the lower compartment; and removable to enable access to that lower compartment, for metered powder use. The hinge typically allows upward swinging of the upper and intermediate compartments, to expose metered powder arrayed in the lower compartment.

As will be seen, the housing may include upper rotor structure covering said upper compartment, and an intermediate wall enclosing said intermediate compartment; also, the upper rotor typically has a side wall extending about the intermediate wall, and the intermediate wall is rotatable to disperse powder from the intermediate compartment to the lower compartment.

These and other objects and advantages of the invention, as well as the details of an illustrative embodiment, will be more fully understood from the following specification and drawings, in which:

DRAWING DESCRIPTION

DETAILED DESCRIPTION

Figure 1:
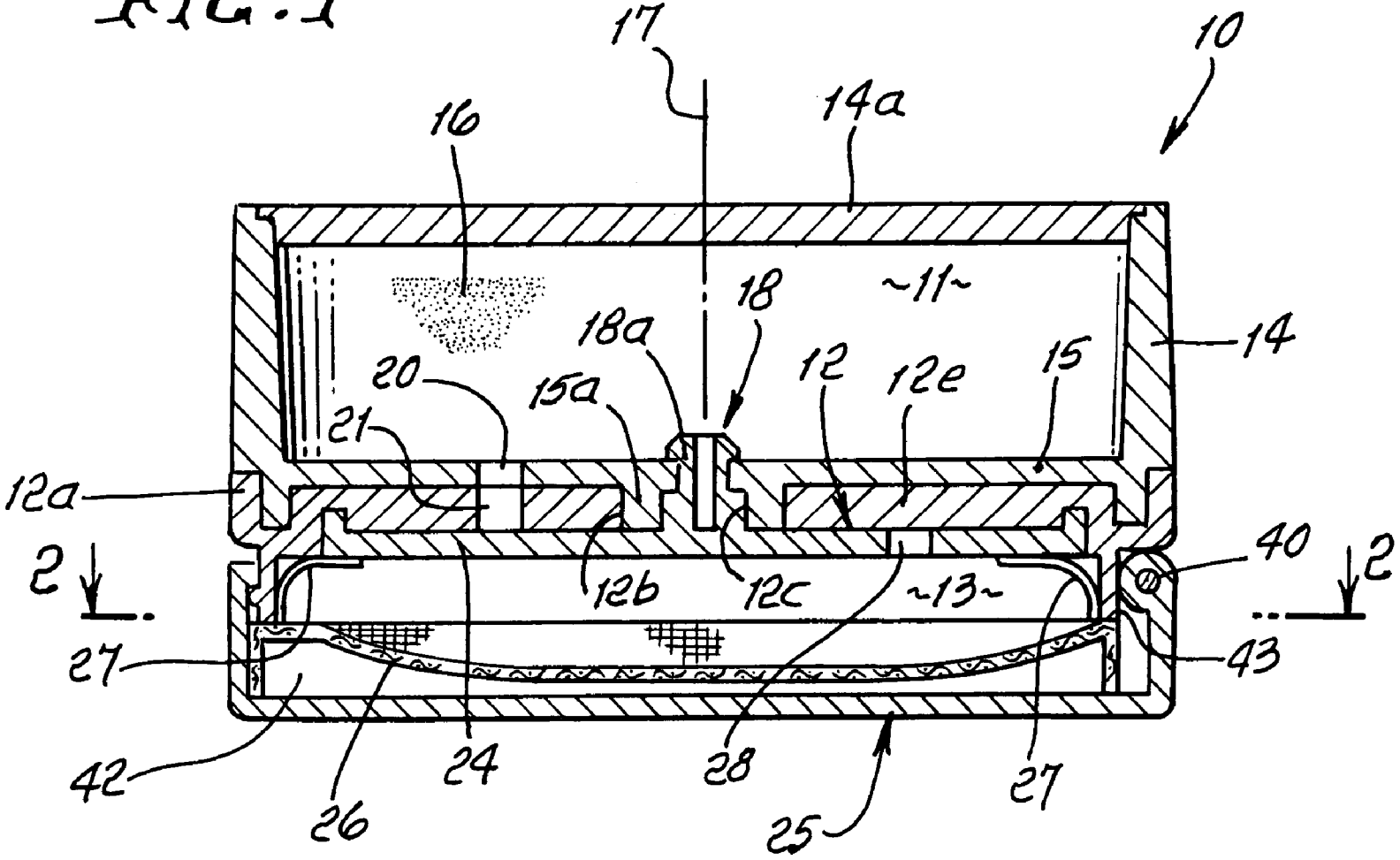
FIG. 1 is a vertical section taken through dispenser apparatus incorporating the invention.
Figure 2:
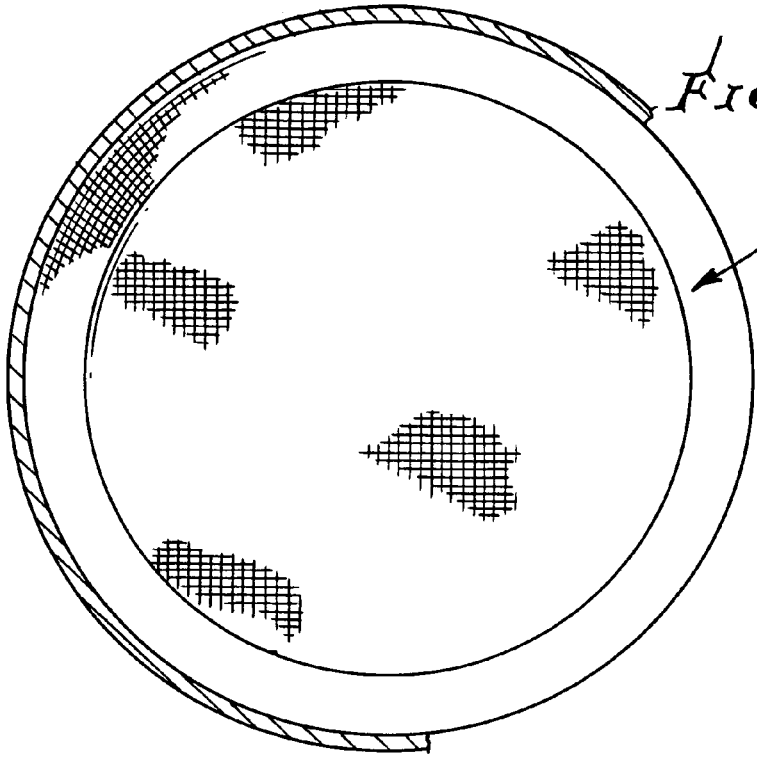
FIG. 2 is a plan view taken on lines 2-2 of FIG. 1.

As seen in FIG. 1, housing structure 10 forms upper, intermediate and lower compartments 11, 12 and 13. Compartment 11 may include an annular side wall 14, horizontal cover 14*a* and a transverse lower wall 15. Cosmetic powder 16 is stored in the interior of the upper compartment, for use. Compartment 11 is rotatable about an upright central axis 17, as on bearing 18, forming an upright axle; accordingly, compartment 11 defines an upper rotor. An annular lower projection 15*a* from lower wall 15 extends about an upright bearing post 18*a* enabling guided rotation of compartment 11, i.e. the upper rotor, about axis 17.

Figure 3:
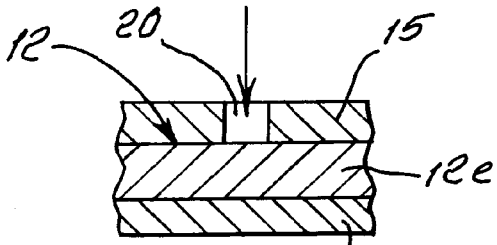
FIG. 3 is a fragmentary view showing powder metering into an opening in the lower wall of an upper compartment.
Figure 4:
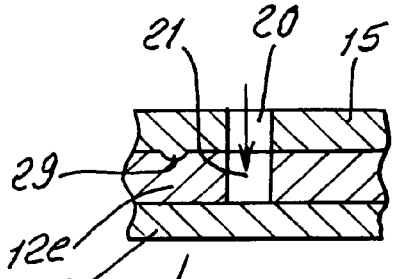
FIG. 4 is a fragmentary view showing powder metering into an opening through an intermediate wall.

Intermediate compartment 12 directly below wall 15, is also rotatable about axis 17, as by manual manipulation of its annular outer wall 12*a*. An annular groove in 12 receives a downwardly extending annular flange on the wall 15, to guide rotation of 12 relative to 11; also a central opening 12*b* formed by 12 receives the projection 15*a* to assist in guiding rotation of 12 relative to 11, maintaining the disc-like wall 12*e* of 12, in rubbing sealing contact with wall 15, blocking powder entry between 12*e* and 15, as during their relative rotation. In this regard, cosmetic powder 16 initially gravitates (see FIG. 3) into a metering opening 20 through wall 15 offset from axis 17, to fill that opening; and when a somewhat like opening 21 through wall 12*e* registers with opening 20, in response to controlled rotation of 11 relative to 12, such powder in 20 gravitates into opening 21. See FIG. 4. Rotation of 11 relative to 12 occurs when 11 is grasped at 14, and when 12 is grasped at 12*a*, the two walls then relatively rotated until a detent therebetween is encountered and sensed, to externally indicate registration of openings 20 and 21.

Figure 5:
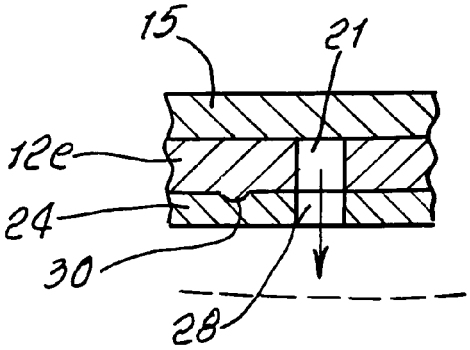
FIG. 5 is a fragmentary view showing powder metering from the opening in the intermediate wall through an opening in a top wall of a lower compartment.

Lower compartment 13 may typically include an upper transverse wall 24 adjacent wall 12*e*, and a receptacle 25. Screen structure 26 is retained in 25; and horizontal wall 24 may be retained to 26 as by frictional retainer or retainers 27. Accordingly, 24 is integrated with 13 so as not to rotate relative to 13. A downward through opening 28 is formed in wall 24, and located to register with opening 21 in response to rotation of compartment 12 relative to compartment 13. See FIG. 5, at which time the metered amount of powder in 21 gravitates through 28 downwardly onto the concave upwardly shaped screen structure 26. Registration of openings 21 and 28 is indicated and detected by engagement of detent structure. Detents as referred to are schematically indicated at locations 29 and 30, in FIGS. 4 and 5.

Thereafter, the upper and intermediate compartments 10 and 11 may be swung upwardly, about 90°, as about a hinge located at 40, and relative to the receptacle 25 and screen 26, to expose the powder gravitated onto 26, for mixing and application to a user, who observes how much powder is presented for use. Excess powder falls through the screen into lower zone 42, of the receptacle. Excess powder application to the user is thereby automatically avoided. Repeated operation of the device enables known metered quantities of powder to be supplied to the screen for use.

Note that a flange 43 on 12 projects downwardly into the receptacle, to be frictionally engaged by the retainer or retainers 27 which are frictionally retained to the screen structure.

What is claimed is:

1. A cosmetic powder dispenser, comprising in combination:

a) housing structure forming upper, intermediate and lower compartments, the structure forming through openings in registering walls associated with the compartments, b) the housing structure including, upper and intermediate rotors whereby rotation of the upper rotor enables a metered quantity of powder to gravitate through a first of the through openings from the upper to the intermediate compartment, and whereby rotation of the intermediate rotor enables said metered quantity of powder to gravitate through an additional opening of said through openings from the intermediate compartment to the lower compartment, for use, c) the upper compartment defining said upper rotor which is rotatable on a central bearing spaced from and below a top wall defined by the upper compartment, d) the upper compartment guiding rotation of the intermediate compartment, e) the upper and intermediate compartments defining adjacent transverse upper and intermediate walls which are in rubbing contact about an axis of rotation defined by said bearing to block powder entry between said adjacent walls, said first opening intersecting said adjacent walls that are in rubbing contact, f) there being a third transverse wall directly below said intermediate wall and defining a further opening of said through openings that registers with said additional opening to pass powder to the lower compartment, there being only one powder passing opening in each wall, and g) an extended screen surface in the lower compartment to receive contact with powder gravitated into the lower compartment, for upward presentation to a user.

2. The combination of claim 1 wherein said surface has a concave side upwardly facing the interior of the lower compartment, for exposure and mixing.

3. The combination of claim 2 wherein said surface has a convex side to receive excess powder for storage and later disposal.

4. The combination of claim 3 wherein the housing includes a receptacle facing said convex side, for receiving the excess powder.

5. The combination of claim 4 including a hinge connecting the receptacle to outer wall structure of the housing.

6. The combination of claim 1 wherein the upper and intermediate compartments define a lid covering the interior of said lower compartment, and upwardly removable to enable access to said lower compartment, for metered powder use.

7. The combination of claim 6 wherein said upper rotor has a side wall extending about said intermediate wall, and said intermediate wall is rotatable relative to the upper and lower transverse walls to dispense powder from the intermediate compartment to the lower compartment.

8. The combination of claim 1 wherein said intermediate wall forming said additional opening extends adjacent said third wall, and a retainer or retainers frictionally retaining said third wall to the lower compartment.

* * * * *